US008886097B2

(12) United States Patent
Nagata et al.

(10) Patent No.: US 8,886,097 B2
(45) Date of Patent: Nov. 11, 2014

(54) CLEANING SYSTEM CONTROL METHOD, FIXING DEVICE, AND IMAGE FORMING APPARATUS INCORPORATING SAME

(75) Inventors: Atsushi Nagata, Kanagawa (JP); Keisuke Kubota, Kanagawa (JP); Takashi Kagami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 205 days.

(21) Appl. No.: 13/585,363

(22) Filed: Aug. 14, 2012

(65) Prior Publication Data

US 2013/0045031 A1 Feb. 21, 2013

(30) Foreign Application Priority Data

Aug. 15, 2011 (JP) ..... 2011-177516

(51) Int. Cl.
*G03G 15/20* (2006.01)

(52) U.S. Cl.
CPC ..... *G03G 15/2025* (2013.01)
USPC ..... 399/327; 399/329

(58) Field of Classification Search
USPC ..... 399/327, 329
See application file for complete search history.

(56) References Cited

U.S. PATENT DOCUMENTS

2007/0237554 A1 10/2007 Mitsuya et al.
2008/0013995 A1 1/2008 Kubota et al.
2008/0170896 A1 7/2008 Kubota et al.
2009/0003898 A1 1/2009 Kayahara et al.
2009/0016786 A1 1/2009 Suzuki et al.
2009/0116880 A1 5/2009 Takagaki et al.
2009/0274477 A1 11/2009 Okamoto et al.
2009/0274494 A1 11/2009 Okamoto et al.
2009/0274495 A1 11/2009 Okamoto et al.

(Continued)

FOREIGN PATENT DOCUMENTS

JP 60-035768 2/1985
JP 10-307503 11/1998

(Continued)

OTHER PUBLICATIONS

U.S. Appl. No. 13/368,015, filed Feb. 7, 2012. Not Yet Published.

*Primary Examiner* — David Gray
*Assistant Examiner* — Michael Harrison
(74) *Attorney, Agent, or Firm* — Harness, Dickey & Pierce, P.L.C.

(57) ABSTRACT

A fixing device includes a rotary fuser member, a rotary pressure member, and a cleaning system. The rotary fuser member is subjected to heating. The rotary pressure member is disposed opposite the fuser member. The cleaning system includes a cleaning web, a feeding mechanism, a positioning mechanism, and a controller. The cleaning web is disposed adjacent to the pressure member to wipe the pressure member. The feeding mechanism is operatively connected to the cleaning web to feed a new, unused portion of the cleaning web toward the pressure member. The positioning mechanism is operatively connected to at least one of the cleaning web and the pressure member to position the cleaning web and the pressure member with respect to each other. The controller is operatively connected with the feeding mechanism and the positioning mechanism to control feeding and positioning of the cleaning web.

19 Claims, 5 Drawing Sheets

(56) References Cited

U.S. PATENT DOCUMENTS

| | | | | |
|---|---|---|---|---|
| 2009/0274496 | A1 | 11/2009 | Okamoto et al. | |
| 2009/0274497 | A1 | 11/2009 | Okamoto et al. | |
| 2009/0274498 | A1 | 11/2009 | Okamoto et al. | |
| 2010/0014897 | A1 | 1/2010 | Seto et al. | |
| 2010/0014903 | A1 | 1/2010 | Seto et al. | |
| 2010/0232844 | A1 | 9/2010 | Saito et al. | |
| 2010/0239292 | A1 | 9/2010 | Fujita et al. | |
| 2011/0222891 | A1 | 9/2011 | Kagami | |
| 2011/0229224 | A1 * | 9/2011 | Watanabe | 399/328 |
| 2011/0311249 | A1 | 12/2011 | Kubota et al. | |
| 2012/0087688 | A1 | 4/2012 | Kubota | |

FOREIGN PATENT DOCUMENTS

| | | | |
|---|---|---|---|
| JP | 11-024484 | | 1/1999 |
| JP | 2002-258657 | | 9/2002 |
| JP | 2003-005562 | | 1/2003 |
| JP | 2003005569 | A | 1/2003 |
| JP | 2005-024619 | | 1/2005 |
| JP | 2005-106873 | | 4/2005 |
| JP | 2005-128380 | | 5/2005 |
| JP | 2006-126291 | | 5/2006 |
| JP | 2008040310 | A | 2/2008 |
| JP | 2009271343 | A | 11/2009 |

* cited by examiner

CLEANING SYSTEM CONTROL METHOD, FIXING DEVICE, AND IMAGE FORMING APPARATUS INCORPORATING SAME

CROSS-REFERENCE TO RELATED APPLICATIONS

This patent application claims priority pursuant to 35 U.S.C. §119 to Japanese Patent Application No. 2011-177516, filed on Aug. 15, 2011, the entire disclosure of which is hereby incorporated by reference herein.

BACKGROUND OF THE INVENTION

1. Technical Field

The present invention relates to a cleaning system control method, a fixing device, and an image forming apparatus incorporating the same, and more particularly, to a method for controlling a cleaning system that includes a cleaning web to clean a rotary member, a fixing device that fixes a toner image in place on a recording medium with heat and pressure, and an electrophotographic image forming apparatus which employs a fixing device with a cleaning capability.

2. Background Art

Modern electrophotographic printers have become increasingly sophisticated to provide a high-speed, high-quality color imaging capability that can produce a clear, sharp image comparable to that of offset lithographic printing. In electrophotographic image forming apparatuses, such as printers, photocopiers, facsimile machines, plotters, or multifunctional machines incorporating several of those imaging functions, an image is formed by attracting toner particles to a photoconductive surface for subsequent transfer to a recording medium such as a sheet of paper. After transfer, the imaging process may be followed by a fixing process using a fixing device, which permanently fixes the toner image in place on the recording medium.

Various types of fixing equipment are known in the art, among which a pressure-assisted thermal fixing device is widely adopted. This type of fixing device employs a pair of generally cylindrical members, such as a looped belt and a roller, one having a heat source such as a halogen heater or the like for fusing toner ("fuser member") and the other being pressed against the heated one ("pressure member"), which together form a heated area of contact called a fixing nip through which a recording medium is passed to fix a toner image onto the medium under heat and pressure.

A particular type of such thermal fixing device is one that employs an endless fuser belt entrained around a fuser roller and a heat roller, with a pressure roller pressing against the fuser roller through the belt to form a fixing nip therebetween. The endless belt exhibits a relatively low heat capacity and thus can be heated more rapidly and sufficiently than a cylindrical roller. Also, compared to a roller-based assembly, the belt-based assembly features an increased size of the fuser roller and the pressure roller, leading to a longer fixing nip and a longer duration of nip dwell time during which a recording medium is subjected to heating within the fixing nip. Further, with suitable adjustment to the stiffness and wall thickness of the fuser roller, the belt-based assembly enables ready separation of recording media from the fuser roller.

With its superiority in terms of heating performance, nip dwell time, and media separation, the belt-based fixing device finds useful application in high-speed color printers, which require efficient heating of the fixing nip and good separation of recording media from the fuser member.

One problem associated with the pressure-assisted thermal fixing device is undesired transfer or offset of toner particles from a recording medium to a fixing member. Ideally, a toner image after fixing permanently adheres to a recording medium on which it is printed. However, toner offset often takes place, for example, due to improper heating at the fixing nip, where adhesion between the fuser member and the fused toner exceeds that between the recording medium and the fused toner, causing a small portion of toner to transfer from the recording medium to an adjoining fixing member.

Two types of toner offset are known: cold offset and hot offset. Cold offset occurs where insufficient heating at the fixing nip causes the toner image to fuse only superficially, leaving an inner portion of the toner layer in a loose, unfused state, which can partially crush up and eventually migrate to the fixing member. Such toner migration is typically accompanied by concomitant image defects, in which the toner image, which is not completely fused or fixed, easily rubs off the printed surface being output. Hot offset, on the other hand, occurs where excessive heating at the fixing nip affects viscoelasticity of the toner image being fused, so that the toner exhibits a high adhesion to the fuser member surpassing a cohesive force of toner particles, resulting in partial migration of toner to the fuser member.

To meet ever-increasing demands for high-quality imaging processes, current trends in electrophotographic printing are to formulate toner with extremely small particles or spherically shaped particles, as in the case of polymerized toner. The problem described above, in particular, cold offset, is pronounced where printing is performed using these newly developed types of toner. Compared to those with varying sizes and aspherical shapes, the small-sized, spherically-shaped toner is susceptible to causing cold offset since it does not easily conduct heat, and therefore is difficult to fuse and melt, particularly when used to print on a rough, irregular surface of uncoated paper.

Not surprisingly, toner offset detracts from image quality due not only to a lack of toner falling off from the recording medium, but also to soiling of the resulting print with offset toner which, once transferred from a recording medium onto the fixing member, is again transferred to another recording medium that enters the fixing nip subsequent to the foregoing recording medium.

Various cleaning techniques have been proposed to keep the fixing member clean of toner particles and other contaminants, which employ a cleaning web, such as an elongated strip of unwoven fabric, to wipe the surface of the fixing member. In a typical configuration, the cleaning web is drawn from a replaceable supply roller and pulled by and wound on a takeup roller, with a tension roller elastically biasing the web against the fixing member to form a cleaning nip therebetween, at which the web rubs against the fixing member.

Such a web-based cleaning system may be designed to constantly supply a new, unused portion of the cleaning web to the cleaning nip, so as to prevent formation of a gap between the fixing member and the web, which, if created, would permit small spherical toner particles to escape from being wiped off at the cleaning nip. Although capable of effectively cleaning the fixing member, such constant supply of cleaning web results in wasteful use of the cleaning web, which is detrimental to environment. Also, accelerated consumption of the cleaning web requires frequent service for the cleaning system and thus eventually increases maintenance cost of the image forming apparatus.

To counteract the problem, a control method has been proposed for a cleaning system which controls supply of a cleaning web from the supply roll into the cleaning nip.

According to this method, the controller adjusts an amount by which the cleaning web is taken up depending on image density (i.e., a ratio of a toner-covered area to an entire image area) of a specific print job processed through the fixing nip. Although designed to prevent an unnecessary, superfluous supply of cleaning web upon processing of relatively light or low-density images, however, such control does not work properly because the image density is not always proportional to the amount of toner offset.

Still another technique has been proposed to provide a cleaning system with increased durability and functionality, which controls activation of a takeup roller to supply an unused portion of the cleaning web to the cleaning nip upon completion of a single print job. Although generally successful for its intended purposes, the technique fails to eliminate an unnecessary supply of the cleaning web, resulting in a shorter lifetime of the cleaning web than would be desired.

BRIEF SUMMARY OF THE INVENTION

Exemplary aspects of the present invention are put forward in view of the above-described circumstances, and provide a novel fixing device.

In one exemplary embodiment, the fixing device includes a rotary fuser member, a rotary pressure member, and a cleaning system. The rotary fuser member is subjected to heating. The rotary pressure member is disposed opposite the fuser member. The fuser member and the pressure member are pressed against each other to form a fixing nip therebetween through which a recording medium passes to fix a toner image thereon under heat and pressure. The cleaning system cleans the pressure member, and includes a cleaning web, a feeding mechanism, a positioning mechanism, and a controller. The cleaning web is disposed adjacent to the pressure member to wipe the pressure member when brought into contact with the pressure member. The feeding mechanism is operatively connected to the cleaning web to feed a new, unused portion of the cleaning web toward the pressure member. The positioning mechanism is operatively connected to at least one of the cleaning web and the pressure member to position the cleaning web and the pressure member with respect to each other. The controller is operatively connected with the feeding mechanism and the positioning mechanism to control feeding and positioning of the cleaning web, so as to advance the web continuously while maintaining the web out of contact with the pressure member.

Other exemplary aspects of the present invention are put forward in view of the above-described circumstances, and provide a novel image forming apparatus incorporating a fixing device.

Still other exemplary aspects of the present invention are put forward in view of the above-described circumstances, and provide a novel cleaning system control method.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
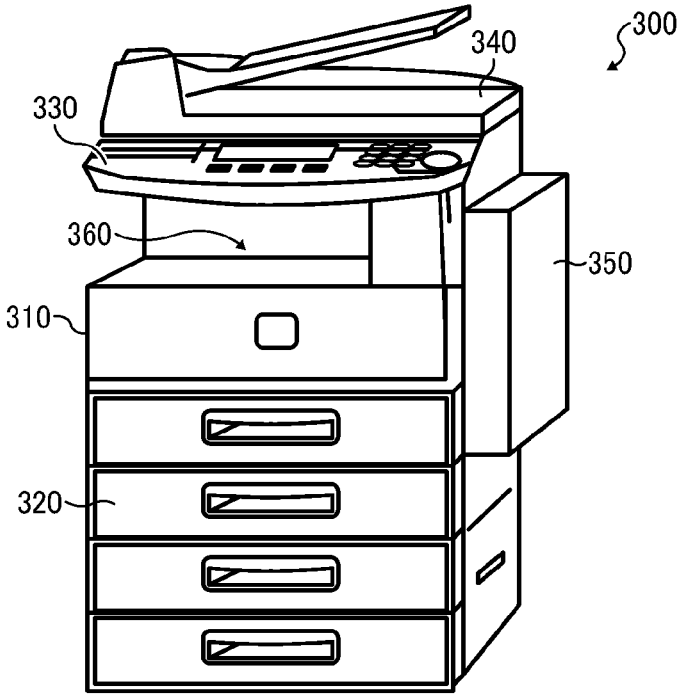
FIG. 1 is a perspective view schematically illustrating an image forming apparatus incorporating a fixing device according to one or more embodiments of this patent specification.

In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views, exemplary embodiments of the present patent application are described.

FIG. 1 is a perspective view schematically illustrating an image forming apparatus 300 incorporating a fixing device 100 according to one or more embodiments of this patent specification.

As shown in FIG. 1, the image forming apparatus 300 is configured as a digital color printer consisting of a generally upper, printing section 310 and a generally lower, media feeding section 320 combined together to form a freestanding unit, as well as an input section including a control panel 330 and an automatic document feeder (ADF) 340 on top of the apparatus body. Also included are a duplex unit 350 connected to the printing section 310, and an in-body output sheet tray 360 disposed between the printer section 310 and the input section.

In the image forming apparatus 300, the printing section 310 includes an image scanner disposed in an upper portion of the printer body to capture image data from an original document input to the ADF 340, and an electrophotographic imaging unit to print a color image on a recording medium such as a sheet of paper.

Specifically, the image scanner includes a solid state image sensor, such as a charge-coupled device (CCD) image sensor, to convert light reflected from an original document into an electrical signal, which undergoes necessary processing to obtain image data for electrophotographic image formation.

The imaging unit includes suitable imaging equipment that performs various steps of electrophotographic imaging process, including charging, exposure, development, transfer, fixing, and cleaning, to reproduce an image on a recording medium according to the image data generated by the image scanner. A general configuration of electrophotographic printing is commonly known in the art, and thus will not be described in detail herein.

The media feeding section 320 includes multiple input sheet trays for accommodating various types of recording media, such as coated paper and uncoated paper. A suitable conveyance system is provided, including rollers and guide plates for conveying recording media from the input sheet trays through the printing section 310 for eventual output to the output sheet tray 360.

The control panel 330 includes a suitable user interface, such as a touch screen and buttons, which allows a user to specify print settings, such as simplex/duplex and type of recording medium, for a particular print job.

The duplex unit 350 includes a conveyance system that reverses a recording medium after processing through the printing section 310 for subsequent re-entry into the printing section 310, which allows for printing on both sides of the recording medium.

The fixing device 100 according to this patent specification is provided in the printing section 310 of the image forming apparatus 300. The fixing device 100 features an effective, efficient cleaning capability that prevents image defects due to offset or undesired transfer of toner particles. Several embodiments of the fixing device 100 and its associated structures are described below with reference to FIG. 2 and subsequent drawings.

Figure 2:
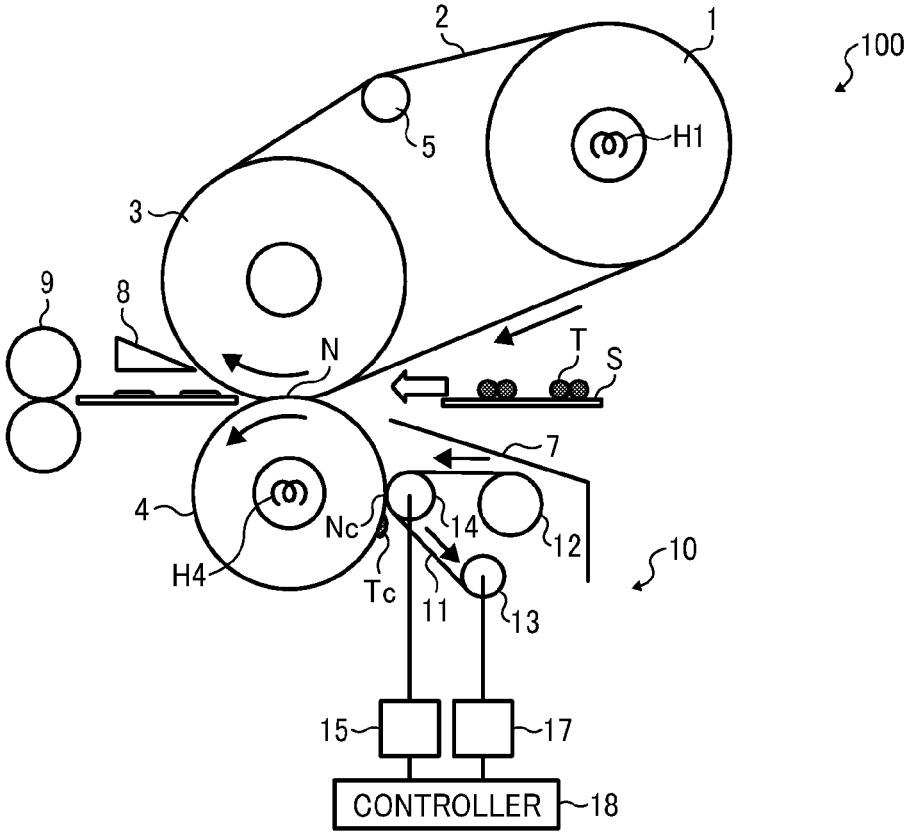
FIG. 2 is an end-on, axial cutaway view schematically illustrating the fixing device according to a first embodiment of this patent specification.

FIG. 2 is an end-on, axial cutaway view schematically illustrating the fixing device 100 according to a first embodiment of this patent specification.

As shown in FIG. 2, the fixing device 100 comprises a belt-based fixing assembly, including a heat roller 1; a fuser roller 3 disposed parallel to the heat roller 1; a rotatable, endless fuser belt 2 entrained around the heat roller 1 and the fuser roller 3; and a rotatable pressure roller 4 disposed opposite the fuser roller 3 via the fuser belt 2. Heaters H1 and H4, such as halogen lamps, are provided in the heat roller 1 and the pressure roller 4, respectively, to internally heat these rollers 1 and 4. The pressure roller 4 presses against the fuser roller 3 via the fuser belt 2 to form a fixing nip N therebetween through which a recording medium such as a sheet of paper S is conveyed along a sheet conveyance path as the fuser belt 2 rotates in a given rotational direction.

Also included in the fixing device 100 are a belt tension roller 5 disposed between the heat roller 1 and the fuser roller 3 inside the loop of the fuser belt 2; a sheet guide 7 disposed upstream from the fixing nip N along the sheet conveyance path; a sheet separator 8 disposed at the exit of the fixing nip N; and a pair of conveyance rollers 9 disposed downstream from the fixing nip N along the sheet conveyance path.

Components of the fixing device 100 described above may be contained in an enclosure housing for removable installation in the image forming apparatus 300. In particular, the heat roller 1, the fuser roller 3, and the pressure roller 4, which extend parallel to each other in an axial, longitudinal direction, are accommodated in the enclosure housing, each having a rotational axis thereof rotatably affixed to the enclosure housing. Also, the roller internal heaters H1 and H4, as well as a rotary driver for rotating the rollers are held stationary on the enclosure housing.

Specifically, in the present embodiment, the fuser belt 2 comprises an endless belt formed of any suitable material that conducts heat. For example, in the present embodiment, the belt 2 is formed of a substrate of polyimide (PI) approximately 90 mm thick, upon which an anti-offset coating, such as perfluoroalkoxy (PFA), is deposited to prevent undesired adhesion of toner to the belt surface. The fuser belt 2 is entrained around the heat roller 1 and the fuser roller 3 while subjected to heating by the heat roller 1 internally heated with the heater H1.

The fuser roller 3 and the pressure roller 4, disposed parallel to each other, each comprises a cylindrical body of any suitable material, such as rubber. The pressure roller 4 is equipped with a biasing mechanism which presses the roller 4 toward the fuser roller 3, or more precisely, toward the central axis of the fuser roller 3 to establish the fixing nip N during operation. The fixing nip N may be de-established by moving the pressure roller 4 away from the fuser belt 2 where desired, e.g., for removing jammed paper.

The belt tension roller 5 comprises a tubular or cylindrical body elastically biased against the fuser belt 2 to generate or maintain a proper tension in the belt 2. For example, in the present embodiment, the tension roller 5 is a tubular elongated piece of aluminum.

The pressure roller 4 is equipped with a rotary drive mechanism for imparting torque to the rotatable body. The rotary drive of the roller 4 includes a motor connected to the roller rotational axis via a reduction gear train to rotate the roller 4 at a given rotational speed, which in turn rotate the fuser belt 2 and the fuser roller 3 pressing against the roller 4 at the same rotational speed. In the example depicted in FIG. 2, rotation of the pressure roller 4 is counterclockwise, causing the fuser belt 2 as well as the fuser roller 3 and the heat roller 1 to rotate clockwise, resulting in a recording sheet S conveyed from right to left through the fixing nip N along the sheet conveyance path.

The heaters H1 and H4 used in the fixing device 100 may be formed of any suitable heat generator, including a halogen heater, a ceramic heater, an electromagnetic induction heater (IH), a resistance heat generator, a carbon heater, and the like.

During operation, the fuser belt 2 is subjected to heating as the heater H1 generates heat which conducts from the heat roller 1 to the fuser belt 2. The motor-driven pressure roller 4 rotates in a rotational direction thereof to in turn rotate the fuser belt 2 and the fuser roller 3 in a rotational direction opposite that of the pressure roller 4.

Then, a recording sheet S bearing an unfixed, powder toner image T enters the fixing device 100 along the sheet conveyance path. As the rotary fixing members rotate together, the recording sheet S, guided by the guide plate 7, passes through the fixing nip N, at which heat from the fuser belt 2 causes toner particles to fuse and melt, while pressure from the pressure roller 4 causes the molten toner to settle onto the sheet surface, thereby fixing the toner image T in place.

After fixing, the recording sheet S exits the fixing nip N with the sheet separator 8 separating the sheet leading edge off the fuser belt 2, followed by the conveyor roller pair 9 forwarding the outgoing sheet S to outside the fixing device 100.

With continued reference to FIG. 2, the fixing device 100 is shown further comprising a cleaning system 10 that includes a cleaning web 11 disposed adjacent to the pressure roller 4 to wipe the pressure roller 4 when brought into contact with the pressure roller 4; a supply roller 12 around which the cleaning web 11 is wound before use; a takeup roller 13 connected with a free, distal end of the cleaning web 11 to take up the cleaning web 11 after use; and a tension roller 14 disposed between the supply roller 12 and the takeup roller 13 and biasable against the pressure roller 4 via the cleaning web 11 to form a cleaning nip Nc at which the cleaning web 11 contacts the pressure roller 4.

In the cleaning system 10, the cleaning web 11 comprises any suitable material with its width, length, and thickness dimensioned to provide adequate cleaning of the pressure roller 4. For example, in the present embodiment, the cleaning web 11 is an elongated strip of nonwoven fabric, such as aromatic polyamide, impregnated with a release agent, such as silicone oil.

The tension roller 14 comprises a cylindrical shaft covered by an elastic material, such as foamed silicone rubber, equipped with a suitable biasing mechanism, such as a spring and a support member, to press the web 11 against the pressure roller 4.

In such a configuration, the cleaning system 10 serves to clean the pressure roller 4 where the roller surface becomes soiled with toner particles Tc or other contaminants originating from the recording sheet S, which undesiredly transfer or offset from the sheet S to the fuser belt 2 and eventually retransfer to the pressure roller 4 through the fixing nip N.

For cleaning the pressure roller 4, the tension roller 14 presses against the pressure roller 4 via the cleaning web 11, thereby bringing the cleaning web 11 into contact with an outer circumferential surface of the roller 4. As the pressure roller 4 rotates in its rotational direction, the cleaning web 11 wipes the outer surface of the roller 4 to remove contaminants Tc from the roller surface.

The cleaning nip Nc thus created extends, for example, to approximately 3 mm to approximately 6 mm long in a circumferential direction of the pressure roller 4. As that portion of the cleaning web 11 in contact with the pressure roller 4 becomes soiled with contaminants, a new, unused portion of the cleaning web 11 is supplied into the cleaning nip Nc by advancing the cleaning web 11 from the supply roller 12 to the takeup roller 13.

Providing the cleaning web for the pressure member, as opposed to the fuser member, is superior in terms of maintaining good imaging performance particularly where the fixing device comprises a belt-based fixing assembly which accommodates high-quality, high-productivity printing using a low-melting point toner. Cleaning an internally heated fuser member with a cleaning web often detracts from print quality, where heat from the fuser member causes toner, in particular, one that exhibits a low melting point, to melt and adhere from the cleaning web to an adjoining surface, or where friction with the cleaning web causes wear and tear on the surface of the fuser member which directly contacts a toner image being processed at the fixing nip.

The inventors have recognized that a cleaning system in which the cleaning web is supplied constantly into the cleaning nip through discontinuous and repeated movement in contact with the pressure member, although generally effective, fails to work properly where variations in operating conditions cause a sudden, temporary increase in the amount of toner migrating from the recording medium to the pressure member, resulting in a corresponding increase in a rate of soiling on the cleaning web.

Figure 3:
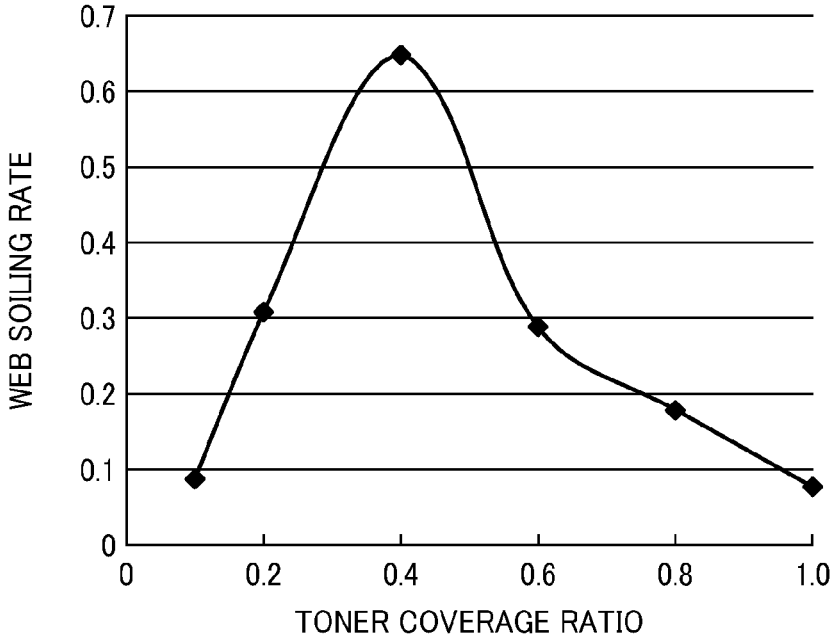
FIG. 3 is a graph showing a relation between soiling rate on a cleaning web and toner coverage ratio on a print produced through a fixing device.

FIG. 3 is a graph showing a relation between soiling rate on a cleaning web and toner coverage ratio on a print produced through a fixing device.

As shown in FIG. 3, the soiling rate on the cleaning web, defined herein as a density of toner or other contaminants per unit area of the cleaning web (which indicates the amount of toner migrating from the recording medium to the pressure member), is not proportional to the toner coverage ratio, representing a density of toner per unit area of the recording medium processed through the fixing nip. That is, the soiling rate increases with increasing toner coverage where the toner coverage ratio is relatively low, and decreases with increasing toner coverage where the toner coverage ratio is relatively high. A maximum soiling rate is reached as the toner coverage ratio reaches a moderate range of approximately 40%, or more precisely, of between 0.35 and 0.45.

The relatively low soiling rate with the toner coverage of below 40% is attributable to the fact that a lower toner coverage, which means a smaller amount of toner present on the recording medium, translates into a smaller amount of toner transferred from the recording medium to the pressure member. The relatively low soiling rate with the toner coverage of above 40%, on the other hand, is explained by the fact that a higher toner coverage makes it easier for toner material to adhere to the recording medium by creating a strong bond not only between the toner and the recording medium but also within the toner layer, resulting in a reduced amount of toner transferred from the recording medium to the pressure member.

Consequently, the soiling rate is maximized with the toner coverage of approximately 40%, where the toner image contains a relatively large dot image area consisting of small, distinct toner dots deposited apart from each other, from which toner particles readily fall off the recording medium due to the absence of strong bonding within the toner layer.

Figure 4:
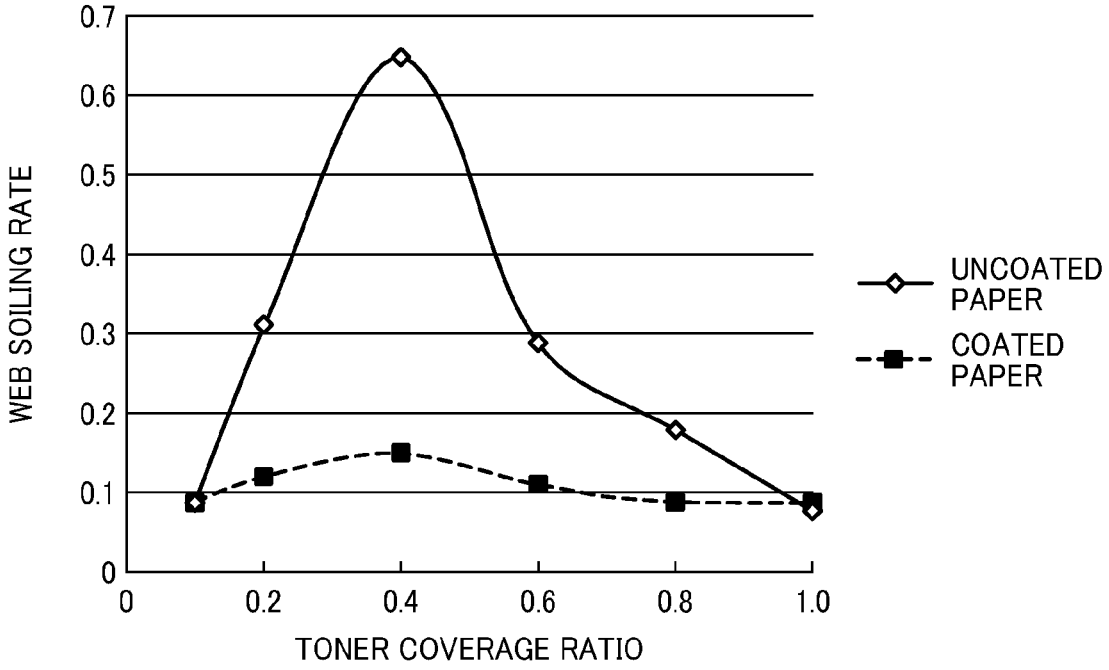
FIG. 4 is a graph showing a relation between soiling rate on a cleaning web and toner coverage ratio on a print produced through a fixing device, measured using coated paper and uncoated paper.

FIG. 4 is a graph showing a relation between soiling rate on a cleaning web and toner coverage ratio on a print produced through a fixing device, measured using coated paper and uncoated paper.

As shown in FIG. 4, the soiling rate on the cleaning web for a given toner coverage ratio is generally lower for coated paper than for uncoated paper. Regardless of the type of recording medium, the soiling rate is maximized at the toner coverage ratio of approximately 40%.

The difference in the soiling rate between paper type is due to the fact that the toner image tends to adhere more firmly to the smooth surface of coated paper than to the rough surface of uncoated paper, as the former can conduct more heat and thus more effectively fuse toner in place than the latter, leaving a smaller amount of contaminants on the pressure member.

Thus, the soiling rate on the cleaning web can vary significantly due to variations in operational parameters, including not only the toner coverage ratio and the coating type of recording medium as described above, but also the mode of printing and other specific properties of recording media. In a worst case scenario where printing is performed in duplex mode using rough, uncoated paper to create a print with a toner coverage of 40%, the cleaning web can be oversaturated or loaded with an excessive amount of toner greater than that properly absorbed by the web material at the cleaning nip. Such oversaturation results in offset toner particles clumping together to form larger masses on the cleaning web, some, if not all, of which will escape from the web woven structure to adjacent surfaces of the fuser member or the pressure member and eventually onto the recording medium, ending up smearing or smudging the resulting print.

Susceptibility to image defects due to offset toner is determined by several factors. One such factor is heat imparted to the cleaning web. For example, chances are high for toner masses to migrate from the oversaturated cleaning web at an initial stage of a print job, where an increased amount of heat is imparted to the cleaning web in contact with the fixing member, making it easier for the toner to flow from the cleaning web to the fixing member. Another factor is the type of toner. For example, where printing is performed using low-melting point toner, which exhibits a higher tendency to melt at low temperatures than normal, conventional toner, toner masses forming on the cleaning web readily migrate as the cleaning web is heated in contact with the fixing member. Low-melting point toner is increasingly used to meet ever-increasing demands for power-efficient imaging systems, as it allows for lowering the level of lowest possible temperature at which the fixing device is operable, so as to save energy in the fixing process which involves the most power-consuming equipment in electrophotographic image formation.

To counteract cleaning failures and concomitant imaging defects due to offset toner from the pressure member, the cleaning system 10 according to this patent specification can control feeding and positioning of the cleaning web 11 to compensate for variations in operational parameters causing a sudden, temporary increase in the amount of contaminants on the pressure member 4 to be collected by the cleaning web 11.

Referring back to FIG. 2, the cleaning system 10 is shown further including a feeding mechanism 17 operatively connected to the cleaning web 11 to feed a new, unused portion of the cleaning web 11 toward the pressure roller 4; a positioning mechanism 15 operatively connected to at least one of the cleaning web 11 and the pressure roller 4 to position the cleaning web 11 and the pressure roller 4 with respect to each other; and a controller 18 operatively connected with the feeding mechanism 17 and the positioning mechanism 15 to control feeding and positioning of the cleaning web 11, so as to advance the web 11 continuously while maintaining the web 11 out of contact with the pressure roller 4.

During operation, the controller 18 detects an operating condition in which a rate of soiling on the cleaning web 11 is expected to increase. Upon detection of the operating condition, the controller 18 directs the positioning mechanism 15 to position the cleaning web 11 away from contact with the pressure roller 4 after completion of a print job. After positioning, the controller 18 then directs the feeding mechanism 17 to feed a new, unused portion of the cleaning web 11 toward the pressure roller 4, such that the cleaning web 11 is advanced continuously while remaining out of contact with the pressure roller 4.

Specifically, in the present embodiment, the controller 18 comprises a central processing unit (CPU) and its associated memory devices that store programs, including those for feeding and positioning control of the cleaning system 10, as well as various types of data necessary for program execution.

The feeding mechanism 17 comprises a rotary stepper motor coupled with the takeup roller 13 to rotate the takeup roller 13 to in turn advance the web 11 from the supply roller 12 to the takeup roller 13.

Figure 5:
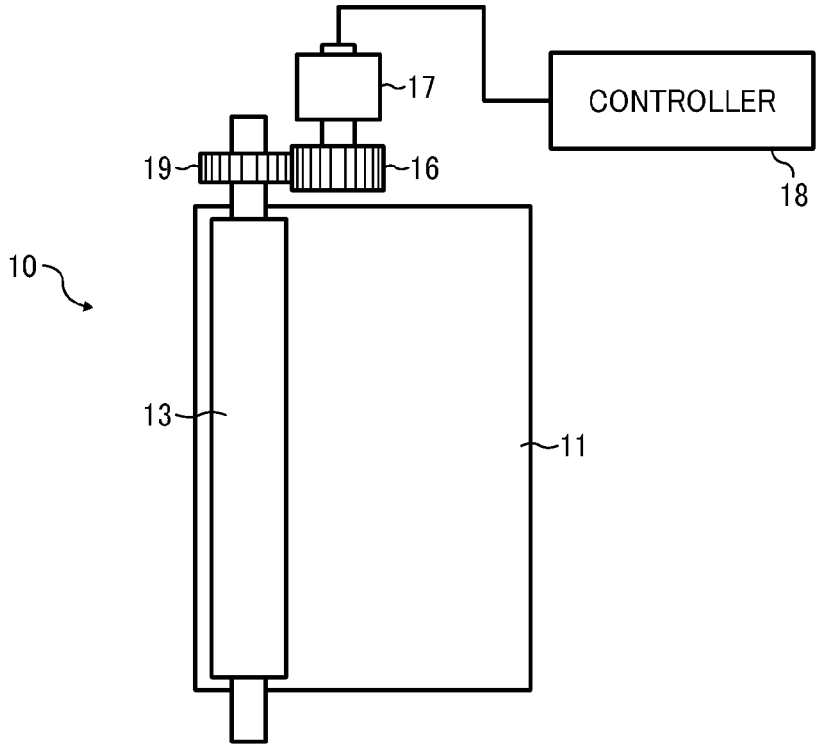
FIG. 5 is a plan, bottom view of a cleaning system included in the fixing device of FIG. 2.

With additional reference to FIG. 5, which is a plan, bottom view of the cleaning system 10 of FIG. 2, the stepper motor 17 is shown having its rotational axis connected with a reduction gear 16 meshing a driven gear 19 that engages a shaft defining the rotational axis of the takeup roller 13. Torque generated by the stepper motor 17 is transmitted via the gears 16 and 19 to the takeup roller 13, which then takes up the cleaning web 11 from the supply roller 12 by an adjustable amount of supply determined by a circumferential speed and a duration of rotation of the takeup roller 13.

Upon activation, the stepper motor 17 rotates in discrete steps or angles of rotation. As the stepper motor 17 rotates or steps, the meshing gears 16 and 19 transmit torque from the stepper motor 17 to the takeup roller 13, which causes the web 11 to unreel by a constant amount proportional to an amount of rotation of the takeup roller 13 during a single step of the stepper motor 17. The takeup amount of the web 11 per each step of the motor 17, which is determined by a reduction ratio of the gear train, may be set to, for example, approximately 0.82 mm. The amount by which the cleaning web 11 is supplied to the cleaning nip Nc upon each activation of the stepper motor 17 may be controlled by adjusting the period of activation time during which the stepper motor 17 is activated to rotate the takeup roller 13.

The positioning mechanism 15 comprises an actuator, such as a motor-driven cam, a solenoid, or the like, coupled with the tension roller 14 to selectively move the tension roller 14 into different operational positions with respect to the pressure roller 4.

Figure 6:
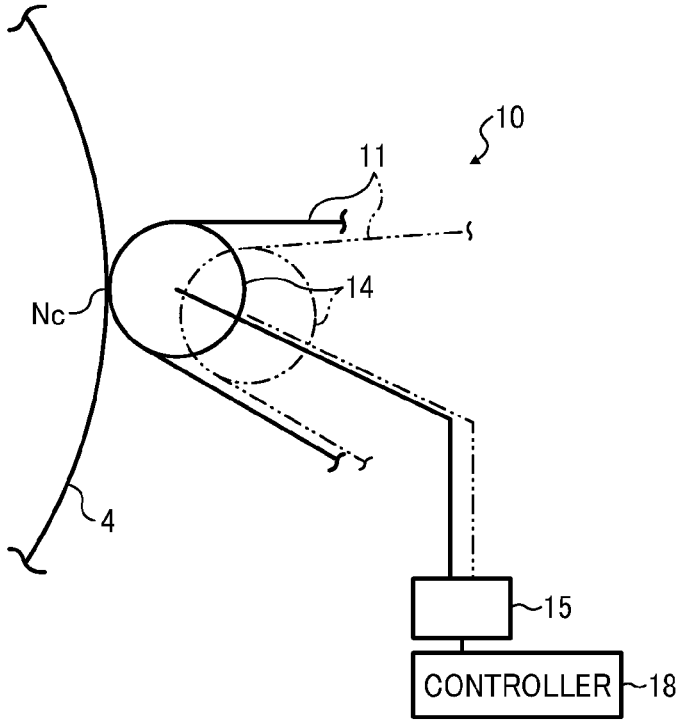
FIG. 6 is an enlarged, partial view of the cleaning system included in the fixing device of FIG. 2.

With additional reference to FIG. 6, which is an enlarged, partial view of the cleaning system 10 of FIG. 2, the positioning mechanism 15 is shown selectively moving the tension roller 14 between a contact position (solid line) in which the tension roller 14 contacts the pressure roller 4 to establish the cleaning nip Nc, and a non-contact position (broken line) in which the tension roller 14 separates from the pressure roller 4 to de-establish the cleaning nip Nc.

More specifically, in the present embodiment, the cleaning system 10 is selectively operable in a first control mode in which the cleaning web 11 is advanced discontinuously and repeatedly by a first amount of web supply while remaining in contact with the pressure roller 4, or a second control mode in which the cleaning web 11 is advanced continuously by a second amount of web supply while remaining out of contact with the pressure roller 4.

In the first control mode, the controller 18 directs the positioning mechanism 15 to move the tension roller 14 into the contact position, so as to establish the cleaning nip Nc. The controller 18 activates the feeding mechanism 17 during a given period of activation to cause the takeup roller 13 to advance the cleaning web 11 by the first amount of web supply whenever the fixing device 100 processes a predetermined number of recording sheets S through the fixing nip N.

Such discontinuous and repeated advancement of the cleaning web 11 in the first control mode may take place upon at least one of completion of printing on a predetermined number of recording media S and execution of a single print job. For example, the controller 18 may activate the feeding mechanism 17 upon completion of a single print job, or occasionally upon processing of a predetermined number of recording sheets S within a single print job where relatively large print jobs are submitted.

The cleaning system 10 enters the second control mode after completion of a print job (that is, after a last one of recording sheets used for a particular print job exits the fixing nip N), where the controller 18 detects an operating condition in which a rate of soiling on the cleaning web 11, as represented by an amount of toner or other contaminants collected by the web material at the cleaning nip Nc, is expected to increase.

Entry into the second control mode may be triggered by any operating condition where variations in operational parameters, such as image density (e.g., toner coverage ratio, dot image area ratio), type of recording medium (e.g., rough/smooth, coated/uncoated, and other user-specific features), mode of printing (e.g., simplex/duplex), or the like, cause a sudden, temporary increase in the amount of toner residues on the pressure member to be collected by the cleaning web. For example, the controller 18 may enter the second control mode after completion of a print job where printing is performed in duplex mode, or where printing is performed on rough paper.

In the second control mode, the controller 18 directs the positioning mechanism 15 to move the tension roller 14 into the non-contact position, so as to de-establish the cleaning nip Nc. The controller 18 then activates the feeding mechanism 17 during a given period of activation to cause the takeup roller 13 to advance the cleaning web 11 by the second amount of web supply. The second amount of web supply may correspond to an area of contact between the pressure roller 4 and the cleaning web 11 at the cleaning nip Nc, which extends, for example, approximately 3 mm to approximately 6 mm in the circumferential direction of the pressure roller 4.

After advancing the cleaning web 11, the controller 18 directs the positioning mechanism 15 to move the tension roller 14 to the contact position, thereby re-establishing the cleaning nip Nc. Upon execution of a subsequent print job, there is substantially no toner or other contaminants present across the cleaning nip Nc between the cleaning web 11 and the pressure roller 4.

Thus, the cleaning system 10 can maintain the cleaning nip Nc in a clean, effective state even where variations in operational parameters cause a sudden, temporary increase in the amount of toner residues on the pressure member to be collected by the cleaning web, so that the cleaning web 11 reliably cleans the pressure roller 4 to prevent formation of toner aggregate masses on the cleaning web 11, which would otherwise result in image defects due to smearing with offset toner migrating from the cleaning web to the fuser member and the pressure member and eventually to the recording medium.

Continuously advancing the cleaning web 11 while maintaining it out of contact with the pressure roller 4 in the second control mode allows for efficient recovery of the cleaning nip, compared to a case where the cleaning web is discontinuously advanced in contact with the pressure member which would cause contaminants collected on the cleaning web to spread out onto the pressure member, resulting in wasting a substantial length of the cleaning web until a clean state of the cleaning nip is reached, or premature entry of a subsequent print job before the cleaning nip is completely cleaned.

Moreover, in the present embodiment, setting the second amount of web supply corresponding to the area of contact between the pressure roller 4 and the cleaning web 11 allows for efficient and effective supply of the cleaning web 11. Insufficient supply of cleaning web (that is, by a length shorter than the length of the cleaning nip) would result in a failure to successfully recover the cleaning nip to a clean state, whereas excessive supply of cleaning web (that is, by a length longer than the length of the cleaning nip) would result in an unnecessary waste of the cleaning web.

Figure 7:
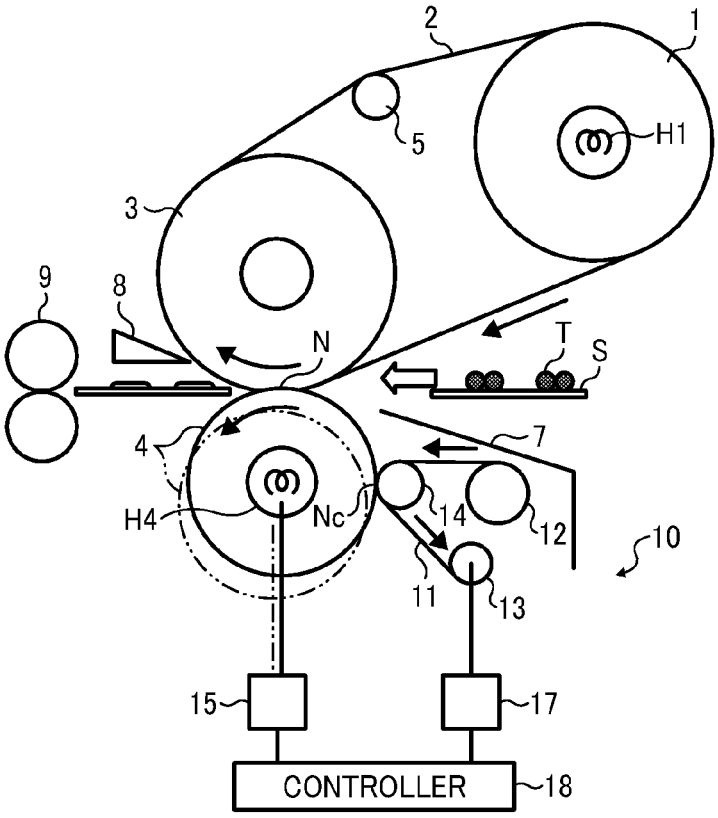
FIG. 7 is an end-on, axial cutaway view schematically illustrating the fixing device according to a second embodiment of this patent specification.

FIG. 7 is an end-on, axial cutaway view schematically illustrating the fixing device 100 according to a second embodiment of this patent specification.

As shown in FIG. 7, the overall configuration of the fixing device 100 is similar to that depicted primarily with reference to FIG. 2, including an endless, fuser belt 2 entrained around a heat roller 1 and a fuser roller 3, a pressure roller 4 pressing against the fuser roller 3 via the fuser belt 3 to form a fixing nip N therebetween, and a cleaning system 10 formed of a cleaning web 11, a feeding mechanism 17, a positioning mechanism 15, and a controller 18 which work together to clean the pressure roller 4.

Unlike the foregoing embodiment, in the second embodiment, the positioning mechanism 15 is provided to the pressure roller 4, instead of the tension roller 14, so that the tension roller 14 is disposed stationary, that is, does not move with respect to the supply roller 12 and the takeup roller 13. Also, in the present embodiment, the fuser roller 3, instead of the pressure roller 4, is equipped with a rotary drive mechanism held stationary on the enclosure housing for imparting torque to the rotatable body.

Specifically, in the present embodiment, the positioning mechanism 15 comprises an actuator coupled with the pressure roller 4 to selectively move the pressure roller 4 into different operational positions. For example, the positioning mechanism 15 may be a motor-driven eccentric cam held against a swivelable arm or flange on which the pressure roller 4 is mounted, which rotates by a given angle of rotation for a given period of time to impart torque to the swivelable arm, so as to in turn move the roller 3 toward and away from the fuser belt 2 and the fuser roller 3. Alternatively, instead, any suitable actuator, for example, a solenoid, may also serve to position the pressure roller 4.

With continued reference to FIG. 7, the positioning mechanism 15 is shown selectively moving the pressure roller 4 between a contact position (solid line) in which the pressure roller 4 contacts both the fuser belt 2 and the tension roller 14 to simultaneously establish the fixing nip N and the cleaning nip Nc, and a non-contact position (broken line) in which the pressure roller 4 separates from both the fuser belt 2 and the tension roller 14 to simultaneously de-establish the fixing nip N and the cleaning nip Nc.

The rotary drive of the fuser roller 3 rotates the roller 3 at a given rotational speed, which in turn rotate the fuser belt 2 and the pressure roller 4 pressing against the roller 3 at the same rotational speed. In the example depicted in FIG. 7, rotation of the fuser roller 3 is clockwise, causing the fuser roller 3 and the heat roller 1 to rotate clockwise, and the pressure roller 4 to rotate counterclockwise, resulting in a recording sheet S conveyed from right to left through the fixing nip N along the sheet conveyance path.

In such a configuration, the cleaning system 10 operates in a manner similar to that depicted above with reference to FIG. 2.

Specifically, as is the case with the foregoing embodiment, the cleaning system 10 is selectively operable in a first control mode in which the cleaning web 11 is advanced discontinuously and repeatedly by a first amount of web supply while remaining in contact with the pressure roller 4, or a second control mode in which the cleaning web 11 is advanced continuously by a second amount of web supply while remaining out of contact with the pressure roller 4.

In the first control mode, the controller 18 directs the positioning mechanism 15 to move the pressure roller 4 into the contact position, so as to simultaneously establish the fixing nip N and the cleaning nip Nc. The controller 18 activates the feeding mechanism 17 during a given period of activation to cause the takeup roller 13 to advance the cleaning web 11 by the first amount of web supply whenever the fixing device 100 processes a predetermined number of recording sheets S through the fixing nip N.

The cleaning system 10 enters the second control mode after completion of a print job (that is, after a last one of recording sheets used for a particular print job exits the fixing nip), where the controller 18 detects an operating condition in which a rate of soiling on the cleaning web 11, as represented by an amount of toner or other contaminants collected by the web material at the cleaning nip Nc, is expected to increase.

In the second control mode, the controller 18 directs the positioning mechanism 15 to move the tension roller 14 into the non-contact position, so as to simultaneously de-establish the fixing nip N and the cleaning nip Nc. The controller 18 then activates the feeding mechanism 17 during a given period of activation to cause the takeup roller 13 to advance the cleaning web 11 by the second amount of web supply.

Thereafter, the pressure roller 4 may be retained in the non-contact position where there is no print job to be subsequently processed. Where a print request is submitted, the controller 18 then directs the positioning mechanism 15 to move the tension roller 14 to the contact position, thereby simultaneously re-establishing the fixing nip N and the cleaning nip Nc. Upon execution of a subsequent print job, there is substantially no toner or other contaminants present across the cleaning nip Nc between the cleaning web 11 and the pressure roller 4.

Thus, the cleaning system 10 can maintain the cleaning nip Nc in a clean, effective state even where variations in operational parameters cause a sudden, temporary increase in the amount of toner residues on the pressure member to be collected by the cleaning web, so that the cleaning web 11 reliably cleans the pressure roller 4 to prevent formation of toner aggregate masses on the cleaning web 11, which would otherwise result in image defects due to smearing with offset toner migrating from the cleaning web to the fuser member and the pressure member and eventually to the recording medium.

Moreover, in the present embodiment, the positioning mechanism 15 provided to the pressure roller 14 can position the pressure roller 4 simultaneously with respect to the fuser belt 2 and the tension roller 14. Such simultaneous positioning of the pressure roller 4 allows for a simple configuration of the fixing device 100, in which effective use of the positioning mechanism provided to the pressure roller 4 eliminates the need to provide a dedicated positioning actuator for the tension roller 14.

Also, positioning the pressure roller 4 away from the fuser belt 2 during idle effectively prevents the pressure roller 4 from overheat due to extended, continuous contact with the fuser belt 2 subjected to heating, which would otherwise result in image defects, in particular, toner blisters. Toner blistering occurs where moisture contained in paper or between toner particles deposited on the paper surface evaporates into vapor bubbles during thermal processing, which penetrate into the coating of paper material or expand within the toner layer to eventually form swelling or blisters on a toner image being fixed. Toner blistering makes the resulting image appear rough and uneven, which detracts much from imaging quality of the fixing process.

Experiments have been conducted to evaluate efficacy of positioning the pressure member away from the fuser member during idle in preventing toner blistering. In the experiments, two belt-based fixing assemblies were prepared: one with the positioning mechanism as that depicted with reference to FIG. 7, and the other without such a positioning capability. After a period of idle time, both fixing devices were activated to sequentially print multiple recording media. Measurement was performed to monitor temperature of the pressure roller in each fixing device during sequential printing.

Figure 8:
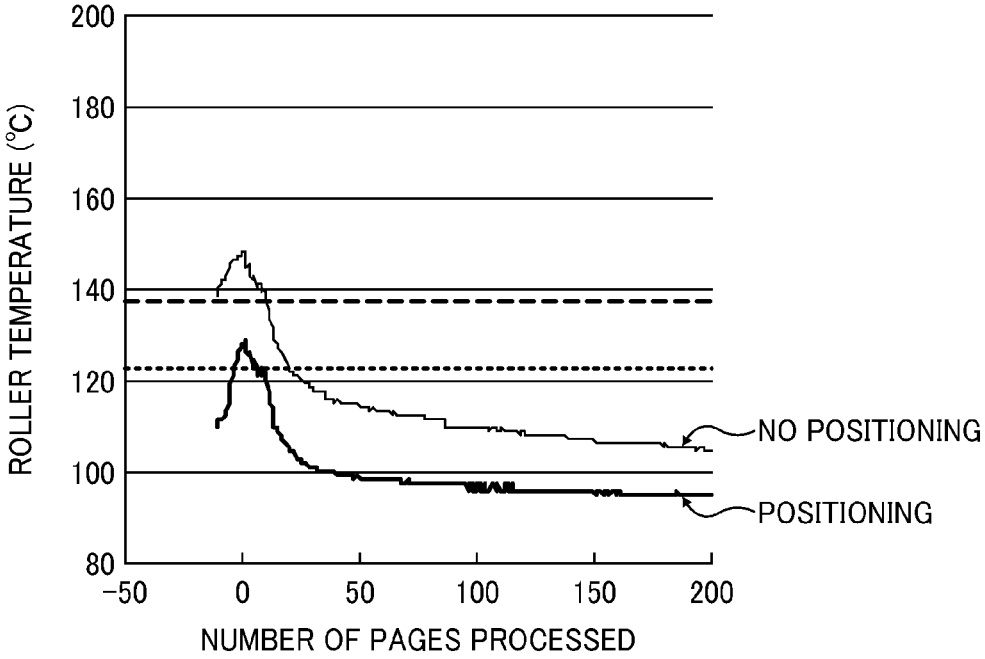
FIG. 8 shows graphs each plotting the measured temperature, in degrees Celsius (° C.), of a pressure roller against the number of pages processed in a fixing device.

FIG. 8 shows graphs each plotting the measured temperature, in degrees Celsius (° C.), of the pressure roller against the number of pages processed in the fixing device, wherein the bold line represents values for the assembly with the positioning capability, and the thin line represents values for the assembly without the positioning capability.

As shown in FIG. 8, in general, the temperature of the pressure roller immediately rises to a maximum point at the initial stage of sequential printing and gradually decreases to a lower, constant level as the number of pages processed increases.

Note that throughout the measurement, the temperature of the pressure roller being positioned away from the fuser member during idle remains consistently lower than that of the pressure roller without the positioning capability. In particular, the maximum temperature of the former only reaches a level slightly above 120° C. (at which toner blistering rarely occurs), whereas the maximum temperature of the latter well exceeds a level of approximately 140° C. (at which some toner blistering will take place). The experimental results indicate that positioning the pressure roller away from the fuser member during idle effectively prevents toner blistering, leading to good imaging quality of the fixing device.

Figure 9:
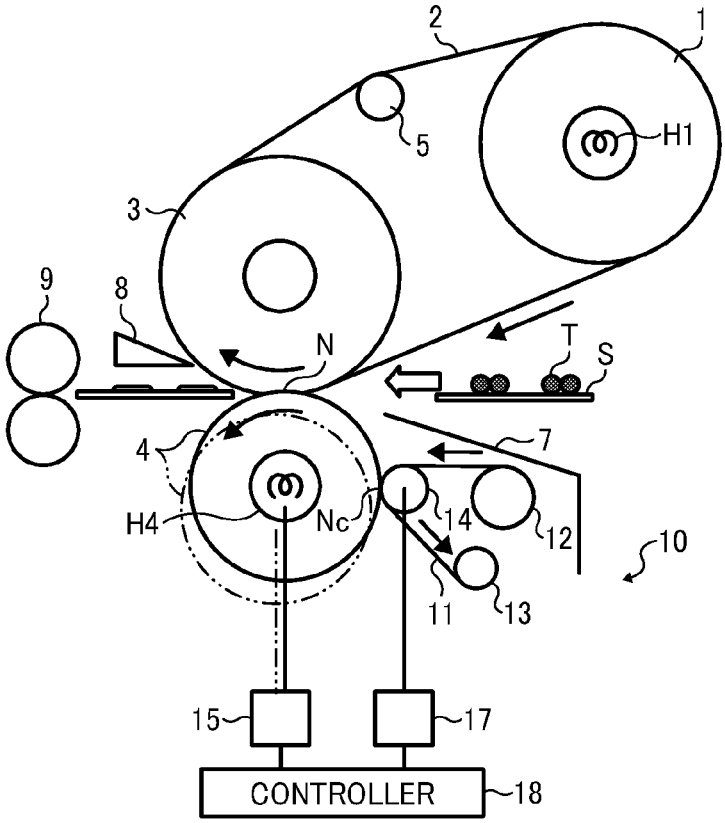
FIG. 9 is an end-on, axial cutaway view schematically illustrating the fixing device according to a third embodiment of this patent specification.

FIG. 9 is an end-on, axial cutaway view schematically illustrating the fixing device 100 according to a third embodiment of this patent specification.

As shown in FIG. 9, the overall configuration of the fixing device 100 is similar to that depicted primarily with reference to FIG. 7, including an endless, fuser belt 2 entrained around a heat roller 1 and a fuser roller 3, a pressure roller 4 pressing against the fuser roller 3 via the fuser belt 3 to form a fixing nip N therebetween, and a cleaning system 10 formed of a cleaning web 11, a feeding mechanism 17, a positioning mechanism 15, and a controller 18 which work together to clean the pressure roller 4.

As is the case with the second embodiment, in the third embodiment, the positioning mechanism 15 is provided to the pressure roller 4, instead of the tension roller 14, so that the tension roller 14 is disposed stationary, that is, does not move with respect to the supply roller 12 and the takeup roller 13. Also, in the present embodiment, the fuser roller 3, instead of the pressure roller 4, is equipped with a rotary drive mechanism held stationary on the enclosure housing for imparting torque to the rotatable body.

Specifically, in the present embodiment, the feeding mechanism 17 comprises a rotary stepper motor coupled with the tension roller 14, instead of the takeup roller 13, to rotate the tension roller 14 to in turn advance the web 11 from the supply roller 12 to the takeup roller 13.

Figure 10:
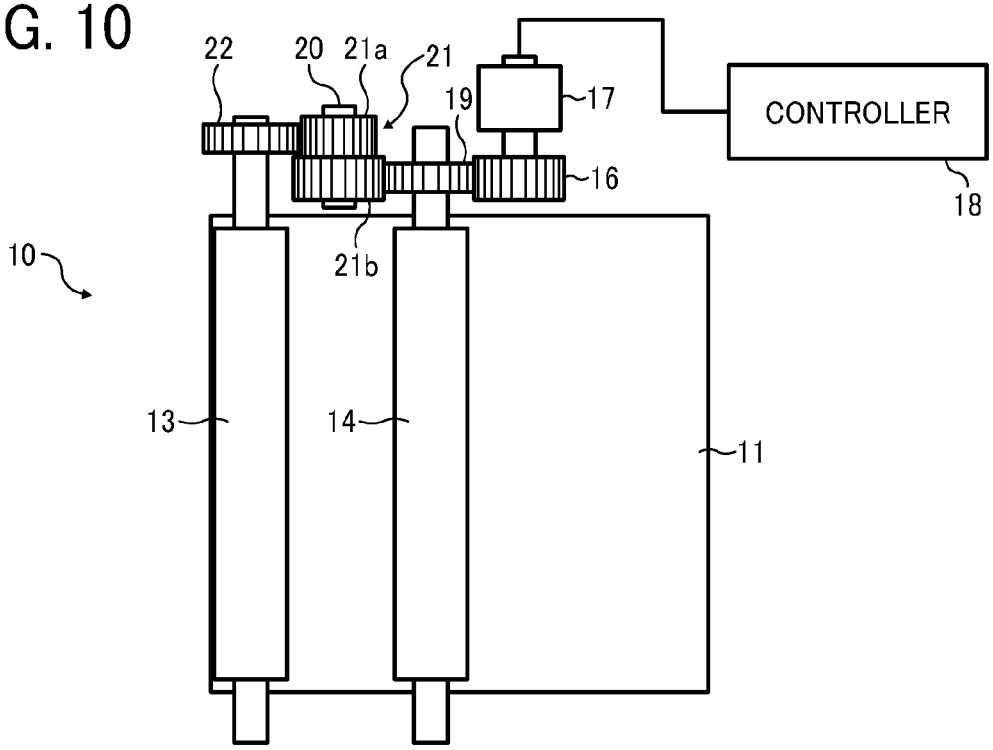
FIG. 10 is a plan, bottom view of a cleaning system included in the fixing device of FIG. 9.

With additional reference to FIG. 10, which is a plan, bottom view of the cleaning system 10 of FIG. 9, the stepper motor 17 is shown having its rotational axis connected with a drive gear 16 meshing a first driven gear 19 that engages a shaft defining the rotational axis of the tension roller 14. The first driven gear 19 is connected to a second driven gear 22 that engages a shaft defining a rotational axis of the takeup roller 13 via a torque limiter 21 that serves to limit excessive torque from being imposed on the takeup roller 13. Torque generated by the stepper motor 17 is transmitted via the gears 16 and 19 to the tension roller 14, which then forwards the cleaning web 11 from the supply roller 12 by an adjustable amount of supply determined by a circumferential speed and a duration of rotation of the tension roller 14.

The force advancing the cleaning web 11 from the supply roller 12 to the takeup roller 13 at the cleaning nip Nc is derived from friction between the tension roller 14 and the cleaning web 11, which is adjustable by selecting design parameters such as materials and geometry of the web assembly. For efficient supply of the cleaning web 11, the frictional force between the tension roller 14 and the cleaning web 11 is set to well exceed that acting between the pressure roller 4 and the cleaning web 11 by setting a sufficiently large coefficient of friction between the tension roller 14 and the cleaning web 11 and a sufficiently large angle at which the cleaning web 11 wraps around the tension roller 14.

In such a configuration, the cleaning system 10 operates in a manner similar to that depicted above with reference to FIG. 7.

Specifically, as is the case with the foregoing embodiment, the cleaning system 10 is selectively operable in a first control mode in which the cleaning web 11 is advanced discontinuously and repeatedly by a first amount of web supply while remaining in contact with the pressure roller 4, or a second control mode in which the cleaning web 11 is advanced continuously by a second amount of web supply while remaining out of contact with the pressure roller 4.

In the first control mode, the controller 18 directs the positioning mechanism 15 to move the pressure roller 4 into the contact position, so as to simultaneously establish the fixing nip N and the cleaning nip Nc. The controller 18 activates the feeding mechanism 17 during a given period of activation to cause the tension roller 14 to frictionally advance the cleaning web 11 by the first amount of web supply whenever the fixing device 100 processes a predetermined number of recording sheets S through the fixing nip N.

The cleaning system 10 enters the second control mode after completion of a print job (that is, after a last one of recording sheets used for a particular print job exits the fixing nip), where the controller 18 detects an operating condition in which a rate of soiling on the cleaning web 11, as represented by an amount of toner or other contaminants collected by the web material at the cleaning nip Nc, is expected to increase.

In the second control mode, the controller 18 directs the positioning mechanism 15 to move the tension roller 14 into the non-contact position, so as to simultaneously de-establish the fixing nip N and the cleaning nip Nc. The controller 18 then activates the feeding mechanism 17 during a given period of activation to cause the tension roller 14 to frictionally advance the cleaning web 11 by the second amount of web supply.

Thereafter, the pressure roller 4 may be retained in the non-contact position where there is no print job to be subsequently processed. Where a print request is submitted, the controller 18 then directs the positioning mechanism 15 to move the tension roller 14 to the contact position, thereby re-establishing the fixing nip N and the cleaning nip Nc. Upon execution of a subsequent print job, there is substantially no toner or other contaminants present across the cleaning nip Nc between the cleaning web 11 and the pressure roller 4.

Thus, the cleaning system 10 can maintain the cleaning nip Nc in a clean, effective state even where variations in operational parameters cause a sudden, temporary increase in the amount of toner residues on the pressure member to be collected by the cleaning web, so that the cleaning web 11 reliably cleans the pressure roller 4 to prevent formation of toner aggregate masses on the cleaning web 11, which would otherwise result in image defects due to smearing with offset toner migrating from the cleaning web to the fuser member and the pressure member and eventually to the recording medium.

Moreover, in the present embodiment, the feeding mechanism 17 provided to the tension roller 14 allows for advancing the cleaning web 11 at a fixed, constant rate regardless of an amount by which the cleaning web 11 has been consumed since installation.

Consider, for comparison purposes, a configuration where the rotary motor is provided to the takeup roller to advance the cleaning web from the supply roller to the takeup roller. In such a configuration, the speed or rate at which the cleaning web is supplied is determined by a circumferential speed of the takeup roller, which depends an outer radius of the takeup roller (that is, a distance between the center of the takeup roller and an outer circumference of the takeup roller defined by a thickness of the cleaning web carried thereon).

Given that the takeup roller is driven at a fixed, constant rotational speed, the supply speed of the cleaning web gradually increases as the circumferential speed of the takeup roller increases with an amount of the cleaning web taken up by the takeup roller, causing an increase in the outer radius of the takeup roller. Such a gradual increase in the web supply speed translates into variations in the length of the cleaning web supplied during each activation of the feeding mechanism, resulting in a higher consumption rate of the cleaning web than is originally designed.

To maintain a constant supply speed of the cleaning web regardless of the consumed amount of the cleaning web, one possible approach is to adjust the rotational speed of the takeup roller to accommodate changes in the outer radius of the takeup roller. Although generally effective, this approach requires a costly or complicated speed controller, and is often difficult to implement.

For example, a cleaning system has been proposed which controls the rotational speed of a takeup roller according to an actual travel speed of a cleaning web being driven by the takeup roller. Such speed control necessitates not only a detector to measure the travel speed of the cleaning web (for example, a transmission densitometer that monitor an optical density on the cleaning web on which reference marks are disposed for speed calculation), but also a controller to adjust the rotational speed of the takeup roller according to the detector output. The need for the detector and the controller inevitably increases cost and complicates control circuitry of the cleaning system.

To counteract the problem, in the present embodiment, the feeding mechanism 17 is configured as a rotary motor coupled with the tension roller 14, instead of the takeup roller 13, to advance the cleaning web 11 from the supply roller 12 to the takeup roller 13, so that the speed or rate at which the cleaning web 11 is supplied is determined by a circumferential speed of the tension roller 14. Since the outer diameter of the tension roller 14 is constant regardless of an amount by which the cleaning web 11 has been consumed since installation, the supply speed of the cleaning web 11 is fixed constant as long as the tension roller 14 is driven at a fixed, constant rotational speed with the stepper motor 17.

Where the feeding mechanism 17 is connected to the tension roller 14, providing the positioning mechanism 15 to the pressure roller 4, instead of the tension roller 14, allows for effective prevention against image defects due to offset toner, while avoiding possible complication of control circuitry which would be encountered where a positioning actuator and a rotary drive motor are both connected to the tension roller.

As mentioned earlier, in the third embodiment, the cleaning system 10 is provided with the torque limiter 21 disposed between the tension roller 14 and the takeup roller 13 to limit excessive torque from being imposed on the takeup roller 13.

Specifically, the torque limiter 21 comprises a double reduction gear train formed of a pair of smaller and larger gears 21*a* and 21*b*, the former meshing the gear 22 provided to the shaft of the takeup roller 13 and the latter meshing the gear 19 provided to the shaft of the tension roller 14. Both gears 21*a* and 21*b* are loosely mounted on a shaft 20, so that they can freely rotate around the shaft 20 where suitable torque is applied.

The gears 21*a* and 21*b* have frictional material, such as felt or elastic material, attached to their inner, interfacial surfaces where the gears 21*a* and 21*b* face each other. Each of the gears 21*a* and 21*b* is loaded with a biasing element, such as a spring, which presses the gears against each other to establish frictional contact between their interfacial surfaces. The biasing force applied to the torque limiter gears 21*a* and 21*b* may be in a range of several hundred grams.

During operation, torque generated by the stepper motor 17 is transmitted to the first driven gear 19 via the gear 16 to rotate the biasing roller 14, as well as to the second driven gear 22 via the paired gears 21*a* and 21*b* to rotate the takeup roller 16.

In the torque limiter 21, the driving force is thus transmitted initially from the first driven gear 19 to the larger gear 21*b*, and then from the larger gear 21*b* to the smaller gear 21*a*. Since transmission of force between the gears 21*a* and 21*b* takes place by friction, any excessive load applied from the larger gear 21*b* does not act on the smaller gear 21*a* where the gears 21*a* and 21*b* slip against each other. Thus, should the takeup roller 13 tend to draw an excessive length of the cleaning web 11 longer than that advanced from the tension roller 14, such tendency causes slippage between the interfacial surfaces of the gears 21*a* and 21*b* to prevent excessive torque from reaching the takeup roller 13.

Provision of the torque limiter 21, consisting of a pair of gears elastically loaded to establish a frictional contact therebetween, enables effective protection against excessive tension in the cleaning web 11 without requiring a complicated overload protection mechanism.

Although in the embodiment described above, the torque limiter 21 is configured as a friction-type torque limiter that limits torque by causing slippage between frictional surfaces, any suitable torque limiter or overload protector may also employed to protect the cleaning web 11 from overload, such as those that include a magnetic element to transmit driving force, or those that include a fluid coupling to conduct rotating power through fluidic viscosity.

Further, the torque limiter 21 may be configured to detect tension in the cleaning web 11, so as to trigger rotation of the takeup roller 13 where the tension in the cleaning web 11 falls below a predetermined lower limit.

In further embodiment, the controller 18 adjusts the first amount of supply by which the cleaning web 11 is advanced discontinuously and repeatedly in the first control mode depending on one or more operational parameters of the fixing device 100.

Specifically, the cleaning system 10 includes a lookup table that associates specific values of an operational parameter with specific lengths of cleaning web to be supplied into the cleaning nip Nc during each activation of the feeding mechanism 17 in the first control mode. Examples of operational parameters include image density (e.g., toner coverage ratio, dot image area ratio), type of recording medium (e.g., rough/smooth, coated/uncoated, and other user-specific features), mode of printing (e.g., simplex/duplex), and the like. The lookup table may be stored in a suitable memory location accessible by the controller 18, such as a memory device incorporated in control circuitry of the image forming apparatus.

Upon receiving a print job, the controller 18 refers to the lookup table to specify the amount of cleaning web based on the print job settings, and accordingly adjusts a duration of time during which the feeding mechanism 17 is activated to move the cleaning web 11 from the supply roller 12 toward the takeup roller 13 by the amount specified with the lookup table.

Adjustment based on one or more operational parameters, which can vary depending on a specific print job and therefore can cause variations in the soiling rate on the cleaning web 11, allows the cleaning system 10 to optimize the supply of cleaning web according to the actual usage of the cleaning web 11. Such optimization eliminates wasteful, unnecessary consumption of the cleaning web material, leading to an extended useful life or longevity of the cleaning web installed in the fixing device 100.

Several examples of the reference table are provided below, each of which includes a toner coverage ratio Y, which refers to a toner density per unit area of the recording medium processed through the fixing nip, as a primary parameter for adjustment of the first amount of web supply. Alternatively, instead, it is possible to use a ratio of a dot image area (i.e., an image area consisting of small, distinct toner dots deposited apart from each other) to an entire surface area of the recording medium.

The toner coverage ratio, as well as the dot image area ratio, can be calculated based on image data obtained from various data sources accommodated in the image forming apparatus, such as an image scanner generating image data containing an image area ratio of an original image in case of photocopying, a host computer that transmits image data specified by a user in case of printing, or a remote data source that transmits image data via a telecommunication system in case of fax or telecopying.

In the following examples, values in the lookup table are merely for exemplary purposes and can vary depending on operating variables and specific configurations of the fixing device and the image forming apparatus, such as type of toner accommodated.

Table 1 shows an example of lookup table that associates specific values of toner coverage ratio Y with lengths of cleaning web to be supplied into the cleaning nip Nc during each activation of the feeding mechanism 17 in the first control mode.

TABLE 1

| Toner coverage ratio Y | Web supply (mm) |
|---|---|
| $Y \leq 0.2$ | 0.82 (default) |
| $0.2 < Y \leq 0.35$ | 1.23 |
| $0.35 < Y \leq 0.45$ | 2.05 |
| $0.45 < Y \leq 0.6$ | 1.23 |
| $0.6 < Y \leq 0.8$ | 0.82 |
| $0.8 < Y$ | 0.82 |

As shown in Table 1, the amount of web supply is adjustable to different discrete values, which generally increase with toner coverage ratio of below 0.4 and decrease with toner coverage ratio of above 0.4.

Specifically, as long as the toner coverage ratio Y does not exceed 0.2, that is, the toner image covers equal to or less than 20% of the entire surface area of the recording sheet S, the supply of cleaning web is set to a default or standard value of 0.82 mm. The amount of web supply is set to a maximum value of 2.05 mm where the toner coverage ratio Y falls within a range above 0.35 and equal to or below 0.45.

As mentioned earlier with reference to FIG. 3, the soiling rate on the cleaning web is not proportional to the toner coverage ratio. That is, the soiling rate increases with increasing toner coverage where the toner coverage ratio is relatively low, and decreases with increasing toner coverage where the toner coverage ratio is relatively high. A maximum soiling rate is reached as the toner coverage ratio reaches a moderate range between 0.35 and 0.45.

Thus, adjustment according to the toner coverage ratio Y allows for optimizing the supply of cleaning web according to the actual usage of the cleaning web 11, which eliminates wasteful, unnecessary consumption of the cleaning web material, leading to an extended useful life or longevity of the cleaning web installed in the fixing device.

Table 2 shows another example of lookup table that associates specific values of toner coverage ratio Y with lengths of cleaning web to be supplied into the cleaning nip Nc, which is modified to change the supply of cleaning web depending on whether printing is performed in simplex mode or in duplex mode.

TABLE 2

| Toner coverage ratio Y | Web supply (mm) Simplex mode | Duplex mode |
|---|---|---|
| Y ≤ 0.2 | 0.82 (default) | 1.31 (default) |
| 0.2 < Y ≤ 0.35 | 1.23 | 1.97 |
| 0.35 < Y ≤ 0.45 | 2.05 | 3.28 |
| 0.45 < Y ≤ 0.6 | 1.23 | 1.97 |
| 0.6 < Y ≤ 0.8 | 0.82 | 1.31 |
| 0.8 < Y | 0.82 | 1.31 |

As shown in Table 2, the amount of web supply changes depending on the mode of printing, such that with each specific range of toner coverage ratio, the supply of cleaning web for duplex printing is approximately 1.6 times greater than that for simplex printing.

Specifically, as long as the toner coverage ratio Y does not exceed 0.2, that is, the toner image covers equal to or less than 20% of the entire surface area of the recording sheet S, the supply of cleaning web is set to a smaller default value of 0.82 mm for simplex printing and a larger default value of 1.31 mm for duplex printing. The amount of web supply is set to a smaller maximum value of 2.05 mm for simplex printing and a larger maximum value 3.28 mm for duplex printing where the toner coverage ratio Y falls within a range above 0.35 and equal to or below 0.45.

The rate of soiling on the cleaning web 11 is higher during duplex printing than during simplex printing, since processing a duplex printed sheet, which has a fixed toner image on its first side facing the pressure member and an unfixed toner image on its second side facing the fuser member, through the fixing nip tends to cause increased soiling on the pressure member as the toner image re-melts on the first side of the sheet due to readily transfer to the pressure member, particularly where low-melting point toner is used.

Thus, adjustment according to the toner coverage ratio Y in combination with the mode of printing allows for optimizing the supply of cleaning web according to the actual usage of the cleaning web 11, which eliminates wasteful, unnecessary consumption of the cleaning web material, leading to an extended useful life or longevity of the cleaning web installed in the fixing device.

Table 3 shows still another example of lookup table that associates specific values of toner coverage ratio Y with lengths of cleaning web to be supplied into the cleaning nip Nc, which is modified to change the supply of cleaning web depending on whether printing is performed on coated paper or uncoated paper.

TABLE 3

| Toner coverage ratio Y | Web supply (mm) Uncoated paper | Coated paper |
|---|---|---|
| Y ≤ 0.2 | 0.82 (default) | 0.49 (default) |
| 0.2 < Y ≤ 0.35 | 1.23 | 0.74 |
| 0.35 < Y ≤ 0.45 | 2.05 | 1.23 |
| 0.45 < Y ≤ 0.6 | 1.23 | 0.74 |
| 0.6 < Y ≤ 0.8 | 0.82 | 0.49 |
| 0.8 < Y | 0.82 | 0.49 |

As shown in Table 3, the supply of cleaning web changes depending on the type of recording medium, such that with each specific range of toner coverage ratio, the supply of cleaning web for coated paper is approximately 0.6 times smaller than that for uncoated paper.

Specifically, as long as the toner coverage ratio Y does not exceed 0.2, that is, the toner image covers equal to or less than 20% of the entire surface area of the recording sheet S, the supply of cleaning web is set to a larger default value of 0.82 mm for uncoated paper, and a smaller default value of 0.49 mm for coated paper. The amount of web supply is set to a larger maximum value of 2.05 mm for uncoated paper and a smaller maximum value of 1.23 mm for coated paper where the toner coverage ratio Y falls within a range above 0.35 and equal to or below 0.45.

As mentioned earlier with reference to FIG. 4, the soiling rate on the cleaning web for a given toner coverage ratio is lower during printing on coated paper than on uncoated paper, since the toner image tends to adhere more firmly to the smooth surface of coated paper than to the rough surface of uncoated paper, as the former can conduct more heat and thus more effectively fuse toner in place than the latter, leaving a smaller amount of contaminants on the pressure member. Supplying a fixed amount of cleaning web irrespective of the type of recording medium used would hence result in an excessive web supply where printing is performed on coated paper.

Thus, adjustment according to the toner coverage ratio Y in combination with the type of recording medium allows for optimizing the supply of cleaning web according to the actual usage of the cleaning web 11, which eliminates wasteful, unnecessary consumption of the cleaning web material, leading to an extended useful life or longevity of the cleaning web installed in the fixing device.

In still further embodiment, the cleaning system 10 may be provided with a lookup table that contains a list of various types of recording media accommodated in the image forming apparatus, such as those commercially available from different manufactures, together with an optimized amount of web supply for each of the media types. The lookup table may be stored in a suitable memory location accessible by the controller 18, such as a memory device incorporated in control circuitry of the image forming apparatus.

Such anangement allows for more accurate control of the cleaning web supply, which promotes efficient, economical use and long life of the cleaning web.

In yet still further embodiment, the cleaning system 10 can modify the amount of supply of the cleaning web 11 as specified by a user for each print job. In such cases, the controller 18 is operatively connected with a user interface, such as the control panel 330 provided on the image forming apparatus 300, which allows a user to specify a desired amount of supply of the cleaning web for input to the controller 18.

Such anangement allows the controller 18 to properly optimize the amount of supply of the cleaning web 11 even where the soiling rate on the cleaning web 11 fluctuates for a known recording medium as changes in environmental and operational conditions cause variations in the amount of toner transferred to the pressure member from the recording medium. Proper optimization of the cleaning web supply maintains good imaging quality of the image forming apparatus without wasteful use of the cleaning web and image defects due to soiling on the pressure member.

To recapitulate, the fixing device 100 according to this patent specification includes a rotary fuser member 2 subjected to heating; a rotary pressure member 4 opposite the fuser member 2; and a cleaning system 10 to clean the pressure member. The fuser member 2 and the pressure member 4 are pressed against each other to form a fixing nip N therebetween through which a recording medium S passes to fix a toner image T thereon under heat and pressure.

The cleaning system 10 includes a cleaning web 11 adjacent to the pressure member 4 to wipe the pressure member 4 when brought into contact with the pressure member 4; a feeding mechanism 17 operatively connected to the cleaning web 11 to feed a new, unused portion of the cleaning web 11 toward the pressure member 4; a positioning mechanism 15 operatively connected to at least one of the cleaning web 11 and the pressure member 4 to position the cleaning web 11 and the pressure member 4 with respect to each other; and a controller 18 operatively connected with the feeding mechanism 17 and the positioning mechanism 15 to control feeding and positioning of the cleaning web 11, so as to advance the web 11 continuously while maintaining the web 11 out of contact with the pressure member 4.

The method for controlling the cleaning system 10 according to this patent specification includes the steps of detection, positioning, and feeding. The detection step detects an operating condition in which a rate of soiling on the cleaning web 11 is expected to increase. The positioning step positions, upon detection of the operating condition, the cleaning web 11 away from contact with the pressure member 4 after completion of a print job. The feeding step feeds a new, unused portion of the cleaning web 11 toward the pressure member 4, such that the cleaning web 11 is advanced continuously while remaining out of contact with the pressure member 4.

By continuously advancing the cleaning web 11 while maintaining it out of contact with the pressure roller 4, the cleaning system 10 can maintain the cleaning nip Nc in a clean, effective state even where variations in operational parameters cause a sudden, temporary increase in the amount of toner residues on the pressure member to be collected by the cleaning web, so that the cleaning web 11 reliably cleans the pressure member 4 to prevent formation of toner aggregate masses on the cleaning web 11, which would otherwise result in image defects due to smearing with offset toner migrating from the cleaning web to the fuser member and the pressure member and eventually to the recording medium.

In further embodiment, the cleaning system 10 further includes a tension member 14 biasable against the pressure member 4 via the cleaning web 11 to form a cleaning nip Nc at which the cleaning web 11 contacts the pressure member 4.

The positioning mechanism 15 may include an actuator coupled with the tension member 14 to selectively move the tension roller 14 between a contact position in which the tension member 14 contacts the pressure member 4 to establish the cleaning nip Nc, and a non-contact position in which the tension member 14 separates from the pressure member 4 to de-establish the cleaning nip Nc. Such arrangement allows for secure positioning of the cleaning web 11.

Alternatively, instead, the positioning mechanism 15 may include an actuator coupled with the pressure member 4 to selectively move the pressure member 4 between a contact position in which the pressure member 4 contacts both the fuser member 2 and the tension member 14 to simultaneously establish the fixing nip N and the cleaning nip Nc, and a non-contact position in which the pressure member 4 separates from both the fuser member 2 and the tension member 14 to simultaneously de-establish the fixing nip N and the cleaning nip Nc. Such arrangement allows for simple configuration of the cleaning system 10.

In still further embodiment, the cleaning system 10 is selectively operable in a first control mode in which the cleaning web 11 is advanced discontinuously and repeatedly by a first amount of web supply while remaining in contact with the pressure member 4, or a second control mode in which the cleaning web 11 is advanced continuously by a second amount of web supply while remaining out of contact with the pressure member 4.

The cleaning system 10 may enter the second control mode after completion of a print job where printing is performed in duplex mode. Also, the cleaning system 10 may enter the second control mode after completion of a print job where printing is performed on rough paper. Such arrangement allows for preventing image defects due to smearing with offset toner particles from the cleaning web 11, even in an operating condition in which a rate of soiling on the cleaning web 11 is expected to increase.

In still further embodiment, the second amount of web supply corresponds to an area of contact between the pressure member 4 and the cleaning web 11. Such arrangement allows for efficient and effective supply of the cleaning web 11 into the cleaning nip Nc, keeping the cleaning nip Nc in a clean, effective state upon entry of a new print job.

In still further embodiment, the controller 18 may adjust the first amount of web supply depending on a toner coverage ratio of the recording medium S processed through the fixing nip N. Also, the controller 18 may adjust the first amount of web supply depending on different operational parameters, including whether printing is performed in simplex mode or in duplex mode, a specific type of recording medium S on which printing is performed, whether printing is performed on coated paper or on uncoated paper, or any combination thereof. Such arrangement allows for optimizing the supply of cleaning web 11, which eliminates wasteful, unnecessary consumption of the cleaning web material, leading to an extended useful life or longevity of the cleaning web 11 installed in the fixing device 100.

In yet still further embodiment, the fixing device 100 further includes a user interface 330 operatively connected with the controller 18 to allow a user to modify the first amount of web supply. Such arrangement allows for user adjustment of the supply of cleaning web 11, which eliminates wasteful, unnecessary consumption of the cleaning web material, leading to an extended useful life or longevity of the cleaning web 11 installed in the fixing device 100.

The image forming apparatus 300 incorporating the fixing device 100 with the cleaning capability benefits from these and other features of the fixing device 100.

Although in several embodiments depicted above, the fixing device is depicted as a belt-based assembly formed of an endless, looped fuser belt paired with a pressure roller opposite the belt, alternatively, instead, the fixing device according to this patent specification may be applicable to any type of imaging system that includes a pair of opposed fixing members disposed opposite to each other to form a nip therebetween.

For example, the fixing device may be configured as a roller-based assembly that employs an internally heated roller paired with a pressure member opposite the roller, or as a pressure-belt assembly that employs an endless belt, instead of a roller, as a pressure member opposite a fuser member. Heaters employed in the fixing assembly may be of any heating element, such as a halogen heater, an electromagnetic induction heater, a resistive heater, a carbon heater, or the like.

Also, the image forming apparatus incorporating the fixing device may be configured otherwise than depicted herein. For example, the printer section may employ any number of imaging stations or primary colors associated therewith, e.g., a full-color process with three primary colors, a bi-color process with two primary colors, or a monochrome process with a single primary color. Further, instead of a tandem printing system, the printing section may employ any suitable imaging process for producing a toner image on a recording medium, such as one that employs a single photoconductor surrounded by multiple development devices for different primary colors, or one that employs a photoconductor in conjunction with a rotary or revolver development system rotatable relative to the photoconductive surface. Furthermore, the image forming apparatus according to this patent specification may be applicable to any type of electrophotographic imaging systems, such as photocopiers, printers, facsimiles, and multifunctional machines incorporating several of such imaging functions.

Numerous additional modifications and variations are possible in light of the above teachings. It is therefore to be understood that, within the scope of the appended claims, the disclosure of this patent specification may be practiced otherwise than as specifically described herein.

What is claimed is:

1. A fixing device comprising:

a rotary fuser member subjected to heating;

a rotary pressure member opposite the fuser member, the fuser member and the pressure member being pressed against each other to form a fixing nip therebetween through which a recording medium passes to fix a toner image thereon under heat and pressure; and a cleaning system to clean the pressure member, the system comprising:

a cleaning web adjacent to the pressure member to wipe the pressure member when brought into contact with the pressure member;

a feeding mechanism operatively connected to the cleaning web to feed a new, unused portion of the cleaning web toward the pressure member;

a positioning mechanism operatively connected to at least one of the cleaning web and the pressure member to position the cleaning web and the pressure member with respect to each other; and a controller operatively connected with the feeding mechanism and the positioning mechanism to control feeding and positioning of the cleaning web, so as to advance the web continuously while maintaining the web out of contact with the pressure member.

2. The fixing device according to claim 1, wherein the cleaning system further comprises a tension member biasable against the pressure member via the cleaning web to form a cleaning nip at which the cleaning web contacts the pressure member, the positioning mechanism includes an actuator coupled with the tension roller to selectively move the tension roller between a contact position in which the tension roller contacts the pressure member to establish the cleaning nip, and a non-contact position in which the tension roller separates from the pressure member to de-establish the cleaning nip.

3. The fixing device according to claim 1, wherein the cleaning system further comprises a tension member biasable against the pressure member via the cleaning web to form a cleaning nip at which the cleaning web contacts the pressure member, the positioning mechanism includes an actuator coupled with the pressure member to selectively move the pressure member between a contact position in which the pressure member contacts both the fuser member and the tension roller to simultaneously establish the fixing nip and the cleaning nip, and a non-contact position in which the pressure member separates from both the fuser member and the tension roller to simultaneously de-establish the fixing nip and the cleaning nip.

4. The fixing device according to claim 1, wherein the cleaning system further comprises:

a supply roller around which the cleaning web is wound before use;

a takeup roller connected with a free, distal end of the cleaning web to take up the cleaning web after use; and a tension roller disposed between the supply roller and the takeup roller and biasable against the pressure member via the cleaning web to form a cleaning nip at which the cleaning web contacts the pressure member, the feeding mechanism includes a rotary motor coupled with the takeup roller to rotate the takeup roller to in turn advance the web from the supply roller to the takeup roller.

5. The fixing device according to claim 1, wherein the cleaning system further comprises:

a supply roller around which the cleaning web is wound before use;

a takeup roller connected with a free, distal end of the cleaning web to take up the cleaning web after use; and a tension roller disposed between the supply roller and the takeup roller and biasable against the pressure member via the cleaning web to form a cleaning nip at which the cleaning web contacts the pressure member, the feeding mechanism includes a rotary motor coupled with the tension roller to rotate the tension roller to in turn advance the web from the supply roller to the takeup roller.

6. The fixing device according to claim 5, wherein the cleaning system further comprises a torque limiter disposed between the tension roller and the takeup roller to limit excessive torque from being imposed on the takeup roller.

7. The fixing device according to claim 1, wherein the cleaning system is selectively operable in a first control mode in which the cleaning web is advanced discontinuously and repeatedly by a first amount of web supply while remaining in contact with the pressure member, or a second control mode in which the cleaning web is advanced continuously by a second amount of web supply while remaining out of contact with the pressure member.

8. The fixing device according to claim 7, wherein the cleaning system enters the second control mode after completion of a print job where printing is performed in duplex mode.

9. The fixing device according to claim 7, wherein the cleaning system enters the second control mode after completion of a print job where printing is performed on rough paper.

10. The fixing device according to claim 7, wherein the second amount of web supply corresponds to an area of contact between the pressure member and the cleaning web.

11. The fixing device according to claim 7, wherein discontinuous and repeated advancement of the cleaning web in the first control mode takes place upon at least one of completion of printing on a predetermined number of recording media and execution of a single print job.

12. The fixing device according to claim 7, wherein the controller adjusts the first amount of web supply depending on a toner coverage ratio of the recording medium processed through the fixing nip.

13. The fixing device according to claim 7, wherein the controller adjusts the first amount of web supply depending on a ratio of a dot image area to an entire surface area of the recording medium processed through the fixing nip.

14. The fixing device according to claim 7, wherein the controller adjusts the first amount of web supply depending on whether printing is performed in simplex mode or in duplex mode.

15. The fixing device according to claim 7, wherein the controller adjusts the first amount of web supply depending on a specific type of recording medium on which printing is performed.

16. The fixing device according to claim 7, wherein the controller adjusts the first amount of web supply depending on whether printing is performed on coated paper or on uncoated paper.

17. The fixing device according to claim 7, further comprising a user interface operatively connected with the controller to allow a user to modify the first amount of web supply.

18. An image forming apparatus, comprising:

an electrophotographic imaging unit to form a toner image on a recording medium; and a fixing device to fix the toner image in place on the recording medium, the fixing device comprising:

a rotary fuser member subjected to heating;

a rotary pressure member opposite the fuser member, the fuser member and the pressure member being pressed against each other to form a fixing nip therebetween through which the recording medium passes;

a cleaning web adjacent to the pressure member to wipe the pressure member when brought into contact with the pressure member;

a feeding mechanism operatively connected to the cleaning web to feed a new, unused portion of the cleaning web toward the pressure member;

a positioning mechanism operatively connected to at least one of the cleaning web and the pressure member to position the cleaning web and the pressure member with respect to each other; and a controller operatively connected with the feeding mechanism and the positioning mechanism to control feeding and positioning of the cleaning web, so as to advance the web continuously while maintaining the web out of contact with the pressure member.

19. A method for controlling a cleaning system that includes a cleaning web to clean a rotary pressure member pressed against a rotary fuser member, the method comprising the steps of:

detecting an operating condition in which a rate of soiling on the cleaning web is expected to increase;

positioning, upon detection of the operating condition, the cleaning web away from contact with the pressure member after completion of a print job; and feeding a new, unused portion of the cleaning web toward the pressure member, such that the cleaning web is advanced continuously while remaining out of contact with the pressure member.

* * * * *